US008671947B2

(12) United States Patent
Quigless

(10) Patent No.: US 8,671,947 B2
(45) Date of Patent: Mar. 18, 2014

(54) DENTAL BITE CONSTRUCTION FOR PERFORMANCE ENHANCING MOUTH GUARDS

(76) Inventor: Kirk C. Quigless, St. Louis, MO (US)

( * ) Notice: Subject to any disclaimer, the term of this patent is extended or adjusted under 35 U.S.C. 154(b) by 0 days.

(21) Appl. No.: 12/428,832

(22) Filed: Apr. 23, 2009

(65) Prior Publication Data

US 2010/0051038 A1 Mar. 4, 2010

Related U.S. Application Data

(60) Provisional application No. 61/094,221, filed on Sep. 4, 2008.

(51) Int. Cl.
*A61C 5/14* (2006.01)

(52) U.S. Cl.
USPC ..... 128/861

(58) Field of Classification Search
USPC ..... 128/861
See application file for complete search history.

(56) References Cited

U.S. PATENT DOCUMENTS

| | | | | |
|---|---|---|---|---|
| 4,977,905 | A | 12/1990 | Kittelsen et al. | |
| 5,152,301 | A | 10/1992 | Kittelsen et al. | |
| 5,234,005 | A | 8/1993 | Kittelsen et al. | |
| 5,339,832 | A | 8/1994 | Kittelsen et al. | |
| 5,718,575 | A | 2/1998 | Cross, III | |
| 5,836,761 | A | 11/1998 | Belvedere et al. | |
| 5,865,619 | A | 2/1999 | Cross, III et al. | |
| 5,879,155 | A | 3/1999 | Kittelsen | |
| 6,082,363 | A | 7/2000 | Washburn | |
| 6,109,266 | A | 8/2000 | Turchetti | |
| 6,505,626 | B2 | 1/2003 | Kittelsen et al. | |
| 6,505,627 | B2 | 1/2003 | Kittelsen et al. | |
| 6,505,628 | B2 | 1/2003 | Kittelsen et al. | |
| 6,508,251 | B2 | 1/2003 | Kittelsen et al. | |
| 6,510,853 | B1 | 1/2003 | Kittelsen et al. | |
| 6,588,430 | B2 | 7/2003 | Kittelsen et al. | |
| 6,675,806 | B2 | 1/2004 | Kittelsen et al. | |
| 6,675,807 | B2 | 1/2004 | Kittelsen et al. | |
| 6,691,710 | B2 | 2/2004 | Kittelsen et al. | |
| 7,299,804 | B2 | 11/2007 | Kittelsen et al. | |
| 7,827,991 | B2 * | 11/2010 | Maher | 128/857 |

* cited by examiner

*Primary Examiner* — Patricia Bianco
*Assistant Examiner* — Raymond E Harris
(74) *Attorney, Agent, or Firm* — Veo Peoples, Jr.

(57) ABSTRACT

An improved performance enhancing mouth guards having transverse pins embedded in the right and left posterior occlusal base portion of the mouth guard, is disclosed.

3 Claims, 3 Drawing Sheets

DENTAL BITE CONSTRUCTION FOR PERFORMANCE ENHANCING MOUTH GUARDS

This application claims the benefit of U.S. Provisional Application No. 61/094,221, filed Sep. 4, 2008.

TECHNICAL FIELD

This invention relates generally to performance enhancing and force absorbing mouth guards, and more particularly to a novel construction for self-fitting boil and bite mouth guards.

BACKGROUND ART

A number of mouth guards currently exist, in the art, for protecting the teeth and for reducing the chance of shock, concussions, and other injuries. These prior art mouth guards are also known to place the lower jaw in the so-called power position, moving the condyle within the temporomandibular joint (TMJ), forwardly away from the nerves and arteries found within the fossa or socket of the joint. In doing so, the mouth guards raise body muscular strength, provide greater endurance, and generally improve physical performance. However, such mouth guards tend to be complex in construction and very expensive.

There are two (2) categories of these prior art performance enhancing mouth guards. The first category is represented by industrially manufactured mouth guards designed according to each individual user's personal morphology. These mouth guards are pressed on imprints of the individual's upper and lower dental arches, and perfectly cover the dental crowns and the gum. Since they are modeled in a way that is wholly similar to a dental prosthesis, their design strictly corresponds to the athlete's anatomy. Their size is calibrated and they guarantee an excellent protective function, a high in-situ stability, and good comfort during their use. These mouth guards are extremely limited in use. The fact that prosthetic specialists are required to undergo a rather long procedure for their preparation, than unaffordable for most consumers.

The second category of prior art performance enhancing mouth guards to be noted are also industrially manufactured. Although they are more comfortable than standard generic mouth guards, they are not as comfortable as the pressed and imprinted types of mouth guards described above. However, they are far less expensive. These mouth guards are known as the boil and bite type, They are made of thermoplastic material which can be immersed in boiling water and self-fitted or shaped by the user in his/her mouth using his/her fingers, tongue, and by imparting biting pressure.

There have been several advancements over the years in these so-called boil and bite mouth guards. Generally, the advancements offer various means to overcome a lack of adequate separation and thickness. That is to say, a marked reduction of 70-92% in occlusal thickness occur when the user bites the mouth guard uncontrollably during use. Consequently, a noticeable reduction in protective capacity is experienced if for example an athlete is hit in the chin. Under such conditions, this insufficient thickness in the mouth guard construction between the user's upper and lower dental arches can be responsible for cranial and cerebral pressures with highly dangerous consequences.

Examples of advancements to overcome this problem include U.S. Pat. No. 5,339,832, which discloses an internal non-softening elastomeric framework embedded within the thermoplastic exterior mouth guard material which exterior softens at the boiling point of water. The mouth guard's internal elastomeric framework defines impact braces lying within the anatomical occlusal regions between the upper and lower posterior teeth, and serving to absorb, attenuate, and dissipate shock. The impact braces contain cushion pads having distinctly enlarged portions that cause the mandible or lower jaw to slide forwardly and slightly downwardly while one is self-fitting the mouth guard. The cushion pads' enlarged portions assure proper fitting of the mouth guard when softened, by prohibiting the user from biting too deeply into the soft material of the thermoplastic mouth guard. But, the enlarged portions were designed to be spherical in shape and to fit within the fossae or sockets of the bicuspid and molar teeth. These enlarged spherical portions have the drawback that precise placement is required. Thus, the mouth guard is difficult to adapt to the many anatomical variations in construction for a statistically sufficient number of individuals to be produced.

In 1999, Kilson disclosed in U.S. Pat. No. 5,879,155, a dental appliance primarily for preventing bruxism or grinding of the teeth. It comprises a non-yielding material placed between the posterior teeth that would maintain the mouth open from one to five millimeters, preventing the mandible from being pulled into the condyler-fossae pressure position, so that clenching action of the jaw would not overburden the TMJ or drive condyles into the fossae. This dental appliance was constructed having composite occlusal posterior pads connected by a wire. The composite posterior pads had an impressionable layer interlocked above a somewhat impressionable layer. The impressionable layer became soft when boiled in water, while the somewhat impressionable layer became somewhat soft when boiled, thus accommodating interdigitation of the upper and lower teeth onto the pad. However, it was necessary to first make dentition impressions of the upper and lower teeth in wax prior to fitting the dental appliance. The appliance was laid on top of the imprint and the lateral separation between posterior occlusal pads could thereby be adjusted. This dentition step usually requires a dental professional.

In 1998, an adjustable customized dental appliance was disclosed in U.S. Pat. No. 5,836,761, having posterior pads which were accurately fitted using occlusal surfaces capable of varying from person to person. To complete the fitting of the appliance, a moldable material was inserted into a channel and the appliance inserted into the mouth for the wearer to bite down on, causing the teeth of the upper and lower jaw to occlude about the appliance. The lower teeth contacted a raised portion in the appliance, preventing the lower teeth from contacting a base portion and from causing an excess of moldable material from being forced out of said channel. The raised portions were conical in shape and slid along the occlusal surfaces until the raised portion fitted into a valley on the occlusal surface of the teeth. The appliance was then removed from the mouth and hardened by an appropriate method to produce the fitted appliance. This process, however, was unduly cumbersome and required a great deal of precision for the conical raised sections to fit precisely into valleys located on the occlusal surface of the teeth.

In 1998, U.S. Pat. No. 5,718,575 disclosed an adjustable customizable performance enhancing dental appliance. The appliance included an occlusal pad which when immersed in hot water had a top layer that became fairly impressionable while its bottom layer became somewhat impressionable to facilitate interdigitation of the upper and lower teeth. Optionally, the occlusal pads had cushions embedded therein with enlarged portions. The enlarged portions of the embedded cushions were arranged to be in the bicuspid or molar region of the posterior teeth and could take the form of spheres, vertical columns, or knobs.

In 1995, U.S. Pat. No. 5,865,619 disclosed a triple composite performance enhancing dental appliance which comprised a pair of occlusal posterior pads made of a triple composite material having a top layer of an impressionable material, an intermediate layer of a hard material, and a bottom layer of a somewhat impressionable material. In a preferred embodiment, protrusions were constructed of a somewhat impressionable material that extended from the bottom layer through the intermediate layer and the top layer. The protrusions served to strengthen the layers and lock them together. But, the protrusions also helped prevent the arch from contorting, and helped to maintain spacing between the teeth to help manipulate the lower jaw forwardly. The bottom layer was wedge-shaped, being thicker posteriorly and thinner anteriorly so as to force the condyle of the jaw to move forwardly and downwardly away from the auricular-temporalis nerve in the supra-tempora artery. This wedge shape placed the jaw into the "power position", alleviating stress on the artery and nerve and increasing blood flow through the artery. The increased blood flow helps to alleviate headache, pain, and stress. But in order to work properly, the plates or bottom layer required tenuously centering adjustments between the teeth.

During 2003 and 2004, a number of U.S. patents issued to John D. Kittelsen disclosing a number of variations in mouth guards. Included among those patents were U.S. Pat. Nos. 6,505,626; 6,505,627; 6,505,628; 6,508,251; 6,510,853; 6,588,430; 6,675,806; 6,675,807; and 6,691,710. Each of these patents described variations in design aspects of a multilayer composite mouth guard having a non-softenable framework, a palate arch and elastomeric traction pads for the posterior portion of the mouth guard. The traction pads contained upwardly projecting interlocking knob projections which passed through apertures and locked the bite plate and framework together as was needed to suitably assure mechanical interlock and included a radius portion to prevent shearing away of the knobs. The traction pads were designed to be wedge-shaped and larger at the posterior end than towards the anterior end. The projections or knobs of the traction pads indexed into the cusp or biting surfaces of the molars.

On Aug. 29, 2000, Mauro Turchetti disclosed in U.S. Pat. No. 6,109,266 a mouth guard and an accompanying mouth piece. The mouth piece portion prevented oro-maxillofacial traumas. It was a separate instrument from the dental appliance. This mouth piece portion comprised transverse rod sections to temporarily assist in spacing the occlusal foundation of the mouth guard. Prior to using the mouth guard, the mouth piece and its rod sections were removed from the mouth guard, leaving a transverse hole in the occlusal section, on the right and left side, at the posterior end. As identified by Turchetti, dysfunctions of the temporomandibular articulation with articular and muscular repercussions were caused by a poor distribution of the occlusal load on the dental elements of the prior art mouth guards. However, the Turchetti mouth guard left a weakened point in the softenable material of the mouth guard even after being hardened. It would be a new found and long desired advancement in the art to obtain the desired occlusal spacing without the drawbacks and disadvantages of the occlusal pads and/or mouth piece portions of the prior art.

SUMMARY OF THE INVENTION

A purpose of the present invention is therefore to provide a pre-formed, mass producible, low cost boil and bite mouth guard able to carry out. A performance enhancing function comparable to that provided by the more expensive made-to-measure mouth guards. According to the invention, this goal is reached by a mouth guard for the prevention of oro-maxillofacial traumas, of the type comprising at least one cavity housing a dental arch, which cavity is bounded by side walls connected to an intermediate base wall, where said one of each cavity is anatomically pre-formed at least in correspondence with its side walls, the latter being shaped with a profile that is complimentary at least to the shape of the average surface of the natural teeth of a statistically predetermined set of individuals.

The internal profile of the cavities is designed to conform with the shape of the teeth and after personalization will contain a plurality of alveoli which individually house each of the teeth.

Since the cavity is so shaped as to encompass the average profiles of a broad group of individuals, a mouth guard produced according to the invention, though designed with a standard shape, is easy to adapt, self-retentive in place, and effectively protective for large groups of athletes. The mouth guard affords the additional advantage of freeing the athlete from the need to keep his/her teeth tightly shut when using it. This feature also allows the athlete to keep the mandible in the natural condition of muscle relaxation which, as is well known, represents the most anatomically correct condition to maintain while practicing the sport, with very particular exceptions. The mouth guard is produced in thermoplastic material and personalization can be achieved by self-forming to a high degree of adaptation to the anatomic shape of his/her own mouth, with no additional cost and with no need for a special's interventions.

The invention does away with the need for prior art limiter devices or other extraneous means for controlling, during the personalization phase, the attainment of the most suitable occlusal thickness.

An additional purpose of the invention is to provide a mouth guard able to prevent certain pathological problems associated with using mouth guards known in the art, by means of personalization which is anatomically correct with respect to the user's intra-oral structure. As utilized herein, mouth piece and mouth guard are one and the same.

Among the features of the mouth guard according to the invention are:

a dimensioning of the vertical thickness of the mouth piece which corresponds to the user's individual physiological position; and an adequate partition of the occlusal forces which relieve muscle structures and alleviate pain, all made possible by embedded transverse pins within the base wall of the mouth guards, on the left and right posterior portions.

Other technical features and characteristics of the invention, according the aforesaid purposes, will be evident from the drawings, detailed description, and content of the claims below. The drawings are provided generally to illustrate non-limiting examples of embodiments of this invention.

DETAILED DESCRIPTION OF THE INVENTION

Figure 1:
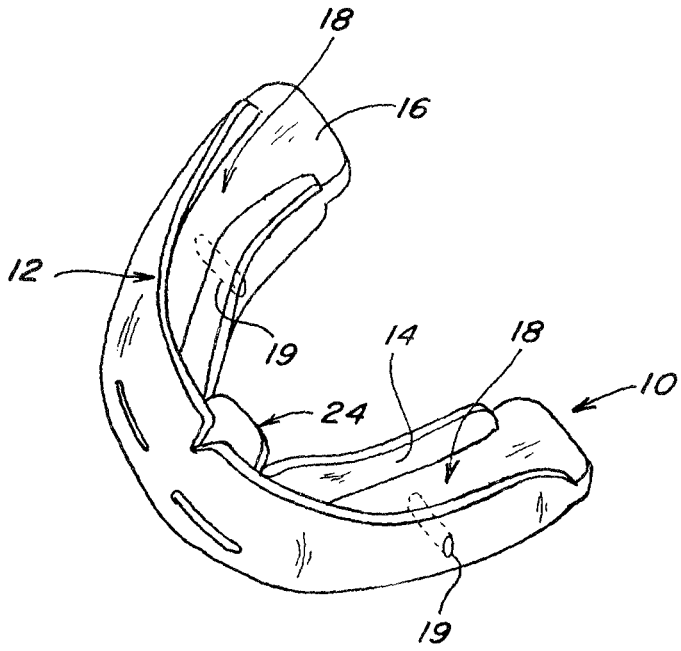
FIG. 1 is a perspective view of the mouth guard of the present invention prior to personalization.
Figure 2:
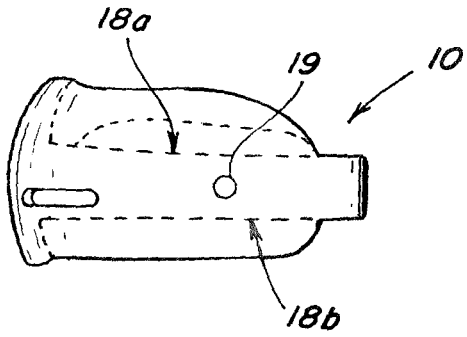
FIG. 2 is a side view of the mouth guard of the present invention prior to personalization.

With reference to the drawings, and in particular to FIG. 1, the performance enhancing boil and bite mouth guard construction 10 of the present invention is adapted for insertion into a user's mouth and for protective engagement with the user's teeth, prior to being heated for personalization and teeth impressions. The mouth guard 10 is generally U-shaped and is comprised of labial wall 12, lingual wall 14 which are upstanding from base 16, and channel 18 is formed by this arrangement. A pre-formed non-softenable pin 19 is embedded on each of the right posterior side and left posterior side of the base 16. The top surface portion 18*a* of channel 18 and bottom surface portion 18*b* are located immediately above and below respective areas relative to pin 19 and are referred to as the top bite portion 18*a* and bottom bite portion 18*b*, which appear on the right and the left side of mouth guard 10.

Mouth guard 10 having been made of predominantly softenable thermoplastic material is immersed in boiling water for about 15 seconds. The mouth guard is then removed from the hot water. Excess water is allowed to drain off the mouth guard 10 by holding it with a spoon or the like. Next, as may be seen in FIG. 5, the wearer places the mouth guard in the mouth so that the interior portion of the mouth guard 10 makes the impression of the upper and lower teeth of the user, while pin 19 because of its location at the posterior end of the dental arches maintain separation in the teeth and a slight slant. The pin 19 need not be precisely at the occlusal surface or biting surface of the teeth but may be located between the teeth and still provide the desired effect.

It is to be noted that the wearer bites down firmly on the appliance. With a strong sucking motion, the wearer draws out all air and water from the mouth guard 10. The rods 19 provide sufficient spacing. The wearer retains the mouth guard in the mouth for at least one minute and, with the mouth guard still in the mouth, takes a drink of cold water. Next, the wearer removes the mouth guard 10 from the mouth and places it in cold water for about 30 seconds.

Figure 3:
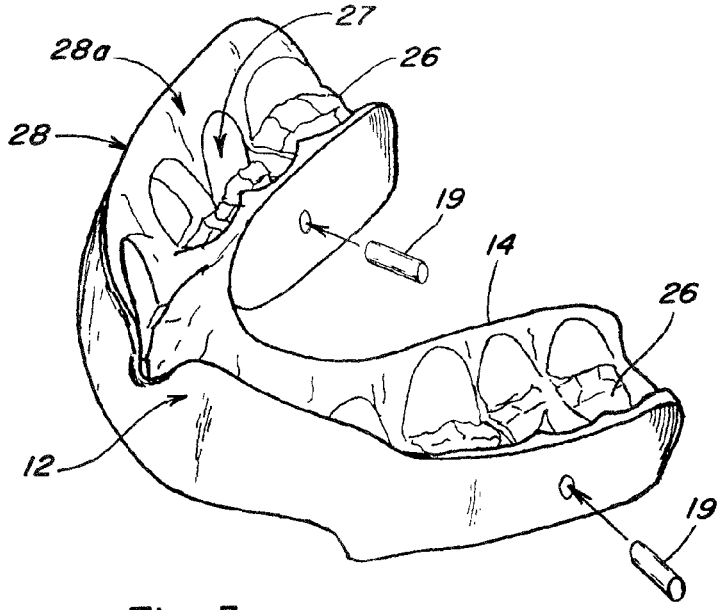
FIG. 3 is a top perspective view of the mouth guard of the present invention after personalization.
Figure 3B:
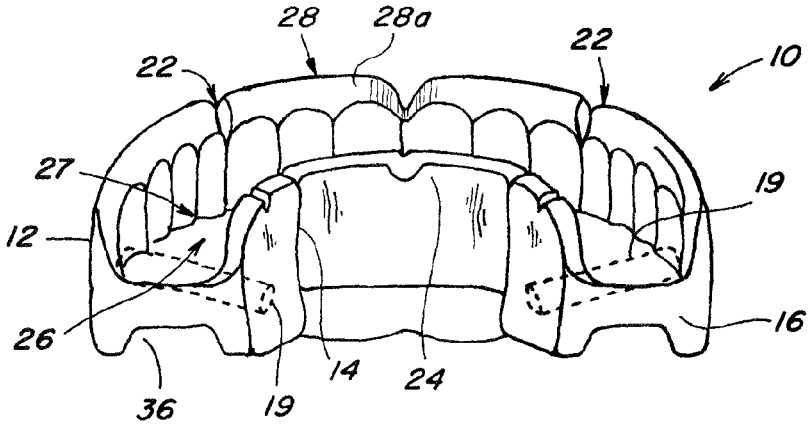
FIG. 3*b* is a bottom perspective view of the mouth guard of the present invention after personalization.

It may be seen particularly from FIG. 3*b*, that the mouth guard is personalized leaving two cavities, an upper cavity 26 and a lower cavity 36, to house the individual's upper and lower dental arches.

The cavities 26 and 36, anatomically formed, are bounded by labial wall 12 and lingual wall 14 which are essentially vertical and connected therebetween by a base wall 16.

Referring back to FIG. 1, the labial wail 12 and lingual wall 14 are shaped toward the interior of the channel 18 with a profile complementing the shape of the average surface of the crown of the natural teeth of a statistically predetermined set of individuals. After personalization, as seen in FIGS. 3 and 3*b*, the labial wall 12 and lingual wall 14 are shaped into a plurality of alveoli 27, each reflecting a single tooth.

As may be seen in FIG. 3, the walls 12 and 14 of the cavities 26 and 36 (note FIG. 3*b*) present rounded edges 28, which are provided with surfaces 28*a* complementing the actual gum surface of the wearer and present interruption areas 22 respectively positioned and shaped to correspond to the frenula of a statistically predetermined set of individuals and with discharge area 24 of the retro incisor palatal papilla, in order to avoid any possibility of anatomic interference with the mouth guard when it is worn.

The presence of the pins 19 as distancing elements prevents the possible excessive tightening of the teeth during the personalization phase from bringing about an excessive reduction in the thickness of the occlusal buffer provided by the base wall 16. The embedded pin negates the need of any ancillary limiter types of instruments while at the same time serving as a strong bite portion during use and said bite portion remains integral to the mouth guard saving cost of construction and enabling more convenient use.

Figure 4:
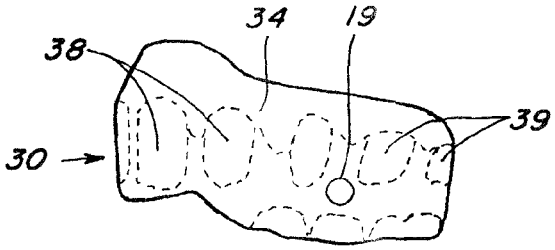
FIG. 4 is a partial side view of the mouth guard of the present invention.

FIG. 4 illustrates the structural features and benefits of pin 19 of mouth guard 10. The mouth 30 generally comprises a rigid upper jaw 32 (which can be more clearly seen in FIG. 5) and a movable lower jaw or mandible which are movably connected at the temporomandibular joint (TMJ) 51 and 52 (also shown in FIG. 5).

More specifically, the rigid upper jaw 32 has gum tissue 34 within mouth 30. Gum tissue 34, as well as the bone thereunder, support anterior teeth (incisors and canines) 38. The gum tissue 34 and the bone thereunder also support posterior teeth (molars and bicuspids) 39. Referring to one side of the human head, the temporal bone 48 is located upwardly and rearwardly of the upper jaw 32 and is in the range of $1/16^{th}$ to $1/32^{nd}$ inches thick. The articular eminence 47 forms the beginning of the fossae 51 or the socket of the temporomandibular joint 51 and 52.

Rearwardly and posteriorly to the articular eminence 47 is located cartilage 44. Through the temporomandibular joint 51 and 52 pass the ariculo-temporalis nerve 46 and supra temporo artery 58.

The movable lower jaw or mandible 42 supports a bone covered by gum just as the upper jaw does and this gum tissue 34 supports anterior teeth 38 and posterior teeth 39. The condyle 52 of the lower jaw 42 forms the ball of the temporomandibular joint 51 and 52. The anatomical structure is the same for both sides of the head.

Figure 5:
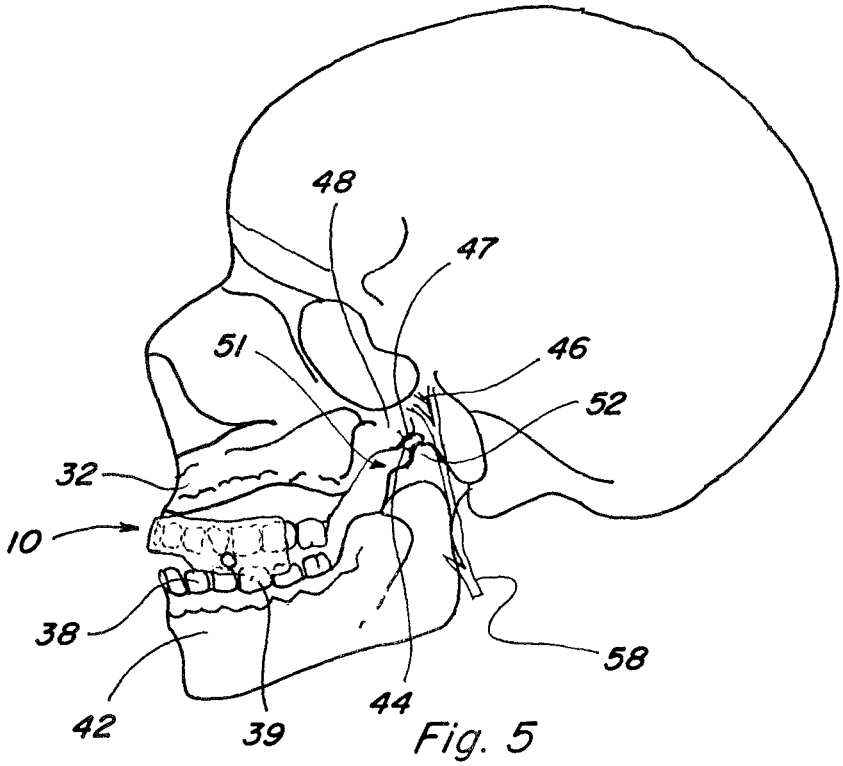
FIG. 5 is a side view of the mouth guard of the present invention in place on a skeletal human figure.
Figure 6:
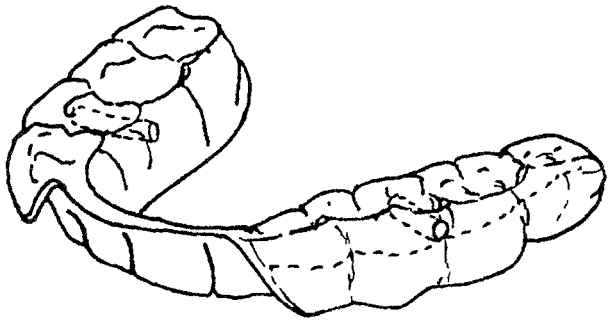
FIG. 6 is a perspective view of a mouth guard construction of the present invention for enveloping primarily the lower teeth.

Finally, FIGS. 4 and 5 illustrate that the pin 19 which is of a hard durable material, permits displacement of the condyle 52 and proper positioning of the lower jaw or mandible 42.

In light of all the foregoing, it should thus be apparent to those skilled in the art that there has been shown and described an improved performance enhancing mouth guard having transverse pins embedded in the right and left posterior occlusal base portion of the mouth guard. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A dental bite construction for mouth guards, enhancing physical performance by a user, the mouth guard being a self-fitting boil and bite dental appliance, having a U-shaped base with labial and lingual walls forming a channel, said appliance sized and configured to be insertable into and to fit within the mouth of said user between the upper and lower teeth of the user, and for improved lower jaw positioning; said dental appliance including right and left bite portions positionable respectively between the right and left upper and lower posterior teeth of the user, to space and maintain said upper and lower posterior teeth apart from one another when said user bites down on said bite portions;

said right and left bite portions each comprising a single integral, non-softenable pin strengthening and remaining in the mouth guard during above said performance by said user, buried within the U-shaped base, and transverse to the direction of the appliance channel, sized and dimensioned to secure safe spacing between said user's upper and lower teeth and to provide a performance enhancing slanted positioning of the lower jaw while said user is biting down on said bite portions during performance; said bite portions abutting the upper and lower posterior teeth of the user and being resistant to normal bite pressure as the user bites down on strengthened bite portions during said performance so as to effect a levering of the back portion of the lower jaw and to position and maintain the jaw in performance enhancing position while bite pressure is being applied to said bite portions by the user and whereby the positioning and maintenance of the lower jaw through the use of said dental appliance, as the user engages in physical actions, enhances said user's performance during same.

2. The bite construction of claim 1 in a boil and bite mouth guard for enveloping primarily the upper teeth.

3. The bite construction of claim 1 in a boil and bite mouth guard for enveloping primarily the lower teeth.

* * * * *